US011251553B2

(12) United States Patent
Yamashita et al.

(10) Patent No.: US 11,251,553 B2
(45) Date of Patent: Feb. 15, 2022

(54) CONNECTOR DEVICE THAT INCLUDES WELDED PORTION

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Takuya Yamashita, Mie (JP); Tatsuo Hirabayashi, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/882,578

(22) Filed: May 25, 2020

(65) Prior Publication Data

US 2020/0388945 A1 Dec. 10, 2020

(30) Foreign Application Priority Data

Jun. 5, 2019 (JP) ..... JP2019-105729

(51) Int. Cl.
*H01R 12/72* (2011.01)

(52) U.S. Cl.
CPC ..... *H01R 12/724* (2013.01)

(58) Field of Classification Search
CPC .. H01R 13/46; H01R 13/5052; H01R 13/516; H01R 13/50; H01R 13/52; H01R 13/5213; H01R 12/724
USPC ..... 439/736, 76.1, 910
See application file for complete search history.

(56) References Cited

U.S. PATENT DOCUMENTS 4,775,333 A * 10/1988 Grider ..... H01R 12/721 264/277
5,244,409 A * 9/1993 Guss, III ..... H01R 13/6691 439/490
5,567,175 A * 10/1996 Warden ..... H01R 13/717 264/272.11
6,139,365 A * 10/2000 Lok ..... H01R 13/6594 439/607.01
6,533,465 B1 * 3/2003 Lesesky ..... G02B 6/3817 385/66

(Continued)

FOREIGN PATENT DOCUMENTS

JP 2017-004698 A 1/2017

*Primary Examiner* — Marcus E Harcum
(74) *Attorney, Agent, or Firm* — Abelman, Frayne & Schwab

(57) ABSTRACT

The present disclosure provides a connector device that is small and easy to manufacture, and that has excellent waterproof performance. The connector device includes a circuit board, a connector, and a molded resin portion. The circuit board has a conductor path. The connector has a housing containing a resin, and a terminal protruding from the housing and configured to be connected to the conductor path. The molded resin portion collectively covers the conductor path, the terminal protruding from the housing, and part of the housing. The housing and the molded resin portion have a welded portion where constituent materials are welded to each other.

12 Claims, 6 Drawing Sheets

(56) References Cited

U.S. PATENT DOCUMENTS 6,655,975 B1 * 12/2003 Liedtke ..... H05K 5/064 439/276
7,066,742 B2 * 6/2006 Liang ..... G06K 19/077 439/606
8,545,238 B2 * 10/2013 Takeda ..... H01R 13/629 439/76.1
8,636,498 B2 * 1/2014 Tsuji ..... G03F 7/0002 425/385
8,864,515 B2 * 10/2014 Oh ..... H01R 13/7175 439/490
9,039,442 B2 * 5/2015 Rapisarda ..... H01M 50/216 439/500
9,054,434 B2 * 6/2015 Kakuta ..... H01R 4/72
9,293,870 B1 * 3/2016 Koczwara ..... H05K 5/0069
9,570,898 B2 * 2/2017 Suzuki ..... H02G 15/007
2001/0023153 A1 * 9/2001 Mayer ..... H03K 17/9505 439/736
2008/0026610 A1 * 1/2008 Frake ..... H01R 13/502 439/76.1
2015/0000971 A1 * 1/2015 Suzuki ..... H01R 13/516 174/542
2015/0009629 A1 * 1/2015 Moon ..... H05K 13/00 361/709
2015/0180157 A1 * 6/2015 Endo ..... H05K 5/0069 439/571
2015/0250072 A1 * 9/2015 Ichikawa ..... H05K 5/0069 439/587
2016/0149355 A1 * 5/2016 Yeom ..... H01R 27/02 439/488
2016/0329646 A1 * 11/2016 Tsai ..... H01R 12/7011
2017/0352976 A1 * 12/2017 Wang ..... G06F 13/4282
2019/0103699 A1 * 4/2019 Yamanaka ..... H05K 5/0052
2021/0066852 A1 * 3/2021 Liniger ..... H01R 13/6392

* cited by examiner

CONNECTOR DEVICE THAT INCLUDES WELDED PORTION

CROSS-REFERENCE TO RELATED APPLICATIONS

This application is based on and claims priority from Japanese Patent Application No. 2019-105729, filed on Jun. 5, 2019, with the Japan Patent Office, the disclosure of which is incorporated herein in their entireties by reference.

TECHNICAL FIELD

The present disclosure relates to a connector device.

BACKGROUND

Japanese Patent Laid-open Publication No. 2017-004698 discloses an electronic device (connector device) provided with a circuit board, a connector, a housing, and a sealing material. The entire circuit board and part of the connector are accommodated within the housing. The housing is provided with a box-shaped case having an upper face that opens, and a cover that closes an upper face opening portion of the case. The sealing material is interposed between the case and the cover of the housing.

The above-described connector device is increased in size due to including the housing. Also, because the separate sealing material is interposed between the case and the cover of the housing, there are many components and therefore manufacturing work is likely to be complicated.

Consequently, it is an object of the present disclosure to provide a connector device that is small and easy to manufacture, and that has excellent waterproof performance.

SUMMARY

A connector device according to the present disclosure includes: a circuit board; a connector; and a molded resin portion. The circuit board has a conductor path, the connector has a housing containing a resin, and a terminal protruding from the housing and configured to be connected to the conductor path, the molded resin portion collectively covers the conductor path, the terminal protruding from the housing, and part of the housing, and the housing and the molded resin portion have a welded portion where constituent materials are welded to each other.

The connector device according to the present disclosure is small and easy to manufacture, and has excellent waterproof performance.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
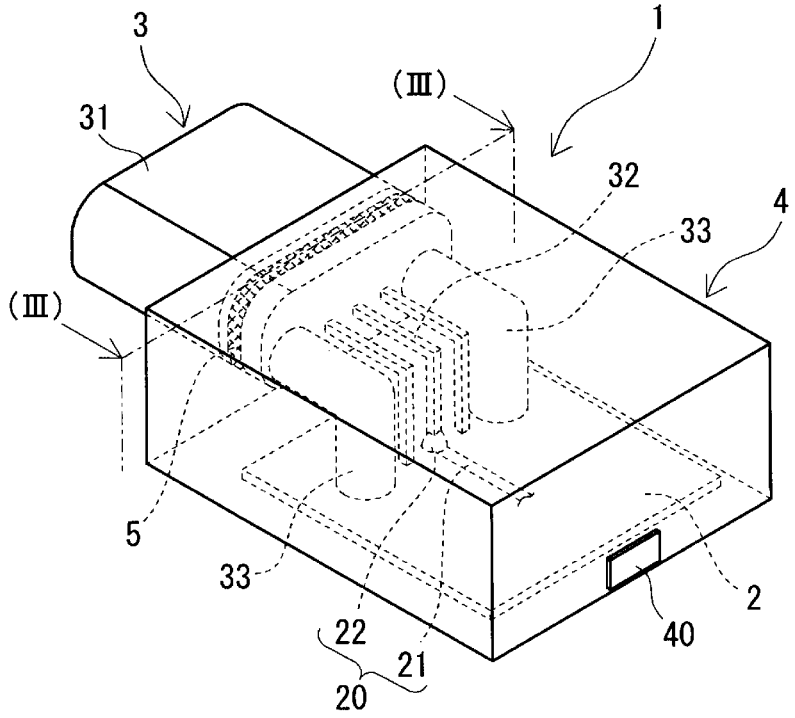
FIG. 1 is a perspective view showing an overview of a connector device according to Embodiment 1.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of the Present Disclosure

First, embodiments of the present disclosure will be listed and described.

(1) A connector device according to one aspect of the present disclosure includes: a circuit board; a connector; and a molded resin portion. The circuit board has a conductor path, the connector has a housing containing a resin, and a terminal protruding from the housing and configured to be connected to the conductor path, the molded resin portion collectively covers the conductor path, the terminal protruding from the housing, and part of the housing, and the housing and the molded resin portion have a welded portion where constituent materials are welded to each other.

The above configuration is excellent for waterproof performance. This is because due to the housing of the connector and the molded resin portion having the welded portion, the adhesion between the housing and the molded resin portion is high. Therefore, it is easy to suppress intrusion of a liquid such as water from a gap between the housing and the molded resin portion. As a result, it is possible to suppress adherence of the liquid to conductive members such as a conductor path, a connector terminals, or the like that are covered with the molded resin portion.

Also, it is easy to reduce the size of the above configuration. Because the molded resin portion collectively covers the circuit board and the like, it is not necessary to separately provide a housing (a case and a cover) that accommodates the circuit board and the like.

Furthermore, the above configuration is easy to manufacture. The reason for this is that because the housing and the sealing material are unnecessary, the number of components is small. In addition, the work of arranging the sealing material on the housing and the work of assembling the housing are unnecessary. The housing is unnecessary because the circuit board and the like are collectively covered by the molded resin portion as described above. The sealing material is unnecessary because sufficient waterproof performance is provided by the welded portion, as described above.

(2) In one aspect of the above connector device, where transmittance of the molded resin portion is defined as 100×a ratio (b1/a1) of a light amount a1 of a laser having a wavelength of 940 nm and a light amount b1 transmitted by the laser through a test piece having a thickness of 2 mm formed of constituent material of the molded resin portion, the transmittance of the molded resin portion is 40% or more.

In the above configuration, the welded portion is easily formed. The welded portion can be formed by laser welding. The molded resin portion having a high transmittance is resistant to absorbing the laser so the laser easily reaches the housing. Therefore, the housing is easily melted. The molded resin portion is easily melted by the heat that melted the housing. Therefore, the constituent material of the housing and the constituent material of the molded resin portion are easily mixed.

(3) In one aspect of the above connector device, where transmittance of the housing is defined as 100×a ratio (b2/a2) of a light amount a2 of a laser having a wavelength of 940 nm and a light amount b2 transmitted by the laser through a test piece having a thickness of 2 mm formed of constituent material of the housing, the transmittance of the housing is 10% or less.

In the above configuration, the welded portion is easily formed. This is because the housing having a low transmittance easily absorbs the laser, and as a result the housing is easily melted by the laser.

(4) In one aspect of the above connector device, the molded resin portion contains a polyamide resin or a polyester.

A polyamide resin has excellent mechanical strength and the like. Therefore, a molded resin portion containing a polyamide resin can easily mechanically protect a member covered by the molded resin portion. A polyester is excellent for electrical insulation, water resistance, and the like. Therefore, a molded resin portion containing a polyester can easily electrically and chemically protect a member covered by the molded resin portion.

(5) In one aspect of the above connector device, the housing contains a polyester.

In the above configuration, it is easy to electrically and chemically protect a terminal or the like.

(6) In one aspect of the above connector device, both the molded resin portion and the housing contain a polyester.

The above configuration is even more excellent for waterproof performance Because the molded resin portion and the housing contain the same type of resin, solubility parameters (SP values) of the molded resin portion and the housing can be set close to each other. Therefore, the molded resin portion and the housing have good conformability to each other. In addition, because the welded portion easily contains the same type of resin, the strength of the welded portion itself easily increases. Therefore, the adhesion between the molded resin portion and the housing becomes even greater.

(7) In one aspect of the above connector device, the molded resin portion has a surface that makes contact with the atmosphere.

In the above configuration, the surface of the molded resin portion is located in an outermost layer. That is, a housing (a case and a cover) that accommodates a circuit board and the like is not provided. Therefore, it is easy to reduce the size of the above configuration.

(8) In one aspect of the above connector device, the molded resin portion is an injection molded body.

In the above configuration, a gap is unlikely to be formed between the circuit board conductor path or the like and the molded resin portion. An injection molded body can be produced by injection molding. In injection molding, the constituent material of a molded resin portion is filled into a molding die while applying pressure to cover the circuit board conductor path or the like. This reason for this is that with injection molding, it is easier to fill the constituent material of the molded resin portion into every corner of the molding die than with cast molding. Because a gap is unlikely to be formed, it is unlikely that water vapor within a gap will condense and result in generation of water droplets.

Also, in the above configuration, there is a high degree of freedom in the shape of the molded resin portion. The reason for this is that, as described above, with injection molding it is easier to fill the constituent material of the molded resin portion into every corner of the molding die than with cast molding.

(9) In one aspect of the above connector device, the circuit board and the connector form a control unit.

The above configuration can be used for a long period of time because the waterproof performance between the housing and the molded resin portion is high, and therefore the above configuration can be suitably used for a control unit. The above configuration can be suitably used for a control unit also because of the small size of the above configuration.

Details of Embodiments of the Present Disclosure

Details of embodiments of the present disclosure will be described below. The same reference numerals in the figures indicate items with the same names.

Embodiment 1

[Connector Device]

A connector device 1 according to Embodiment 1 will be described with reference to FIGS. 1 to 3. The connector device 1 of this embodiment includes a circuit board 2 and a connector 3 (see FIGS. 1 and 2). The circuit board 2 has a conductor path 20. The connector 3 has a housing 31 containing a resin, and a terminal 32 protruding from the housing 31 and configured to be connected to the conductor path 20. One feature of the connector device 1 of the present embodiment is that the connector device 1 has a molded resin portion 4 that collectively covers the conductor path 20, the terminal 32, and part of the housing 31, and a welded portion 5 where the housing 31 and the molded resin portion 4 are welded. Below, each configuration will be described in detail. In the following description, the circuit board 2 side of the connector device 1 is referred to as the lower side, and the connector 3 side is referred to as the upper side. In addition, in the direction orthogonal to the vertical direction, the side where the connector 3 is arranged is the front, and the opposite side is the rear. Further, left and right are defined in a direction perpendicular to both the vertical direction and the front-rear direction.

[Circuit Board]

The circuit board 2 allows mounting of electronic components (not shown) such as a semiconductor relay and the connector 3. A printed board can be used as the circuit board 2. The circuit board 2 has the conductor path 20. The conductor path 20 refers to a location of the conductive member constituting the electric circuit of the circuit board 2 that is exposed on the surface. The conductor path 20 includes, for example, a conductor pattern 21 of the circuit board 2, a terminal (not shown) of an electronic component mounted on the circuit board 2, a solder 22 that connects the terminal of the electronic component or the terminal 32 of the connector 3 to the conductor pattern 21, and the like. In this embodiment, the entire circuit board 2 is embedded in the molded resin portion 4.

[Connector]

The connector 3 connects a mating connector (not shown) to the connector device 1. The mating connector is connected to in-vehicle electrical components or the like through a wire harness. The connector 3 is mounted on the circuit board 2. The connector 3 includes the housing 31, the terminal 32, an attachment portion 33, and a fixing member 34 (see FIG. 2).

(Housing)

The housing 31 is fitted to the mating connector. The shape of the housing 31 is hood-like (cylindrical). An opening portion (not shown) of the housing 31 opens outward from the front edge of the circuit board 2. In the present embodiment, a part of the housing 31 on the opposite side (rear side) as the opening portion is embedded in the molded resin portion 4.

<Transmittance>

It is preferable that the transmittance of the housing 31 is low. The transmittance is defined as 100×a ratio (b2/a2) of a light amount a2 of a laser having a wavelength of 940 nm and a light amount b2 transmitted by the laser through a test piece having a thickness of 2 mm formed of constituent material of the housing 31. The housing 31 having a low transmittance easily absorbs the laser. That is, the housing 31 having a low transmittance is easily melted by the laser. Therefore, the welded portion 5 described later is easily formed. The transmittance of the housing 31 is preferably, for example, 10% or less. The housing 31 having a transmittance of 10% or less easily absorbs the laser and melts easily, and therefore the welded portion 5 is easily formed. The transmittance of the housing 31 is more preferably 7% or less, and particularly preferably is 5% or less. The color of the housing 31 is preferably opaque black or gray or the like. This is because these colors easily absorb the laser.

<Material>

The housing 31 preferably contains, for example, a polyester. A polyester is excellent for electrical insulation, water resistance, and the like. Therefore, the housing 31 containing a polyester can easily electrically and chemically protect the members covered by the molded resin portion 4. A typical example of a polyester is polybutylene terephthalate (PBT). The housing 31 preferably further contains a coloring agent. As the coloring agent, a coloring agent that allows the housing 31 to have a low transmittance may be used. An example of the coloring agent is carbon black. By containing carbon black, the color of the housing 31 can be easily made black.

(Terminal)

The terminal 32 electrically connects the mating connector and the circuit board 2. The terminal 32 is provided so as to pass through a rear wall on the opposite side as the opening of the housing 31. The terminal 32 is drawn out from the inside of the housing 31 to the rear side of the housing 31 and extends toward the circuit board 2 side (the lower side). One end of the terminal 32 is arranged inside the housing 31. One end of the terminal 32 is electrically connected to a mating connector portion inside the housing 31. The other end of the terminal 32 passes through the circuit board 2. That is, the other end of the terminal 32 protrudes downward from the lower face of the circuit board 2. The other end of the terminal 32 is electrically connected to the conductor pattern 21 of the circuit board 2. The solder 22 can be used for the electrical connection between the other end of the terminal 32 and the conductor pattern 21. In this embodiment, the terminal 32 is formed of a metal wire bent substantially at a right angle. All of the terminal 32 is embedded in the molded resin portion 4.

(Attachment Portion)

The fixing member 34 is attached to the attachment portion 33. In the present embodiment, two attachment portions 33 are provided integrally on the left and right of the rear end of the housing 31. Each attachment portion 33 is formed in an L-shape extending rearward and downward from the rear end of the housing 31. The lower face of each attachment portion 33 is provided with a screw hole to which the fixing member 34 (a screw described later) is fastened. By tightening the screw, the lower face of each attachment portion 33 is fixed to the circuit board 2. The housing 31 is fixed to the circuit board 2 by fixing the attachment portions 33 to the circuit board 2. In this embodiment, each attachment portion 33 is formed of a round bar member bent substantially at a right angle. The entirety of each of the attachment portions 33 is embedded in the molded resin portion 4.

(Fixing Member)

The fixing member 34 fixes the housing 31 to the circuit board 2. As the fixing member 34, for example, a screw can be used. In this embodiment, the fixing member 34 is formed of a resin screw. Here, each of two fixing members 34 is inserted into an insertion hole (not shown) of the circuit board 2 from below, and is attached to each attachment portion 33 of the housing 31. The housing 31 is fixed to the circuit board 2 by attaching the fixing members 34 to the attachment portions 33. The fixing members 34 (the head of the screw) protrude downward from the lower face of the circuit board 2. In the present embodiment, the entirety of each of the fixing members 34 is embedded in the molded resin portion 4 (see FIG. 2).

[Molded Resin Portion]

The molded resin portion 4 mechanically, electrically, and chemically protects the conductor path 20 of the circuit board 2 and the terminal 32 protruding from the housing 31 of the connector 3 from an external environment. The molded resin portion 4 collectively covers the conductor path 20 of the circuit board 2, the terminal 32 protruding from the housing 31 of the connector 3, and part (the rear end side) of the housing 31. In the present embodiment, the molded resin portion 4 covers the entire circuit board 2 and an area of the connector 3 except the opening portion side of the housing 31 (the rear side of the housing 31, the terminal 32, the attachment portions 33, and the fixing members 34).

The molded resin portion 4 has a surface that comes into contact with the atmosphere. Coming into contact with the atmosphere means that the outermost surface of the connector device 1 is not covered by a case or the like but is exposed. The surface of the molded resin portion 4 of the present embodiment comes into contact with the atmosphere over the entire area of that surface. That is, the connector device 1 is caseless. Therefore, the connector device 1 is small.

(Transmittance)

It is preferable that the transmittance of the molded resin portion 4 is high. The transmittance is defined as 100×a ratio (h1/a1) of a light amount a1 of a laser having a wavelength of 940 nm and a light amount b1 transmitted by the laser through a test piece having a thickness of 2 mm formed of constituent material of the molded resin portion 4. The molded resin portion 4 having a high transmittance is resistant to absorbing the laser so the laser easily reaches the housing 31. Therefore, the welded portion 5 described later is easily formed. The transmittance of the molded resin portion 4 is preferably, for example, 40% or more. The molded resin portion 4 having a transmittance of 40% or less easily transmits the laser, and therefore the welded portion 5 is easily formed. The transmittance of the molded resin portion 4 is more preferably 45% or more, and particularly preferably is 50% or more. The color of the molded resin portion 4 is preferably colorless and transparent, white and transparent, opaque white, or the like. This is because these colors easily transmit the laser.

(Material)

The molded resin portion 4 preferably contains, for example, a polyamide resin or a polyester. A polyamide resin is excellent for mechanical strength or the like. Therefore, the molded resin portion 4 containing a polyamide resin can easily mechanically protect the members covered by the molded resin portion 4. A polyester is excellent for electrical insulation, water resistance, and the like. Therefore, the molded resin portion 4 containing a polyester can easily electrically and chemically protect the members covered by the molded resin portion 4.

The housing 31 and the molded resin portion 4 preferably contain the same type of resin. Because the housing 31 and the molded resin portion 4 contain the same type of resin, the solubility parameters (SP values) of the housing 31 and the molded resin portion 4 can be set close to each other. Therefore, the housing 31 and the molded resin portion 4 have good conformability to each other. In addition, because the welded portion 5 easily contains the same type of resin, the strength of the welded portion 5 itself easily increases. Therefore, the adhesion between the housing 31 and the molded resin portion 4 becomes even greater. For example, when the housing 31 contains a polyester, the molded resin portion 4 preferably contains a polyester.

The molded resin portion 4 is preferably an injection molded body. In an injection molded body, a gap is less likely to be formed between the conductor path 20 and the like of the circuit board 2 and the molded resin portion 4, as compared with a cast molded body. The injection molded body can be produced by injection molding. In the injection molding, the constituent material of the molded resin portion 4 is filled into a molding die while applying pressure to cover the conductor path 20 and the like of the circuit board 2. Therefore, in injection molding, the constituent material of the molded resin portion 4 is more easily filled into every corner of the molding die than with cast molding. Because a gap is unlikely to be formed, it is unlikely that water vapor within a gap will condense and result in generation of water droplets. Further, the injection molded body has a high degree of freedom in the shape of the molded resin portion 4. The reason for this is that, as described above, in injection molding, the constituent material of the molded resin portion 4 is more easily filled into every corner of the molding die than with cast molding.

Because the molded resin portion 4 is an injection molded body, a trace portion 40 of a gate is provided. The trace portion 40 is a location corresponding to a gate for filling the constituent material of the molded resin portion 4 into a cavity of the mold when molding the molded resin portion 4. An accessory portion having a portion corresponding to the gate is formed in the molded resin portion 4 produced by injection molding. By removing the accessory portion, the trace portion 40 of the gate is formed in the molded resin portion 4. The accessory portion may have a portion corresponding to a sprue in addition to a portion corresponding to the gate, and may further have a portion corresponding to a runner. The accessory portion can be removed by, for example, breaking off the accessory portion.

[Welded Portion]

Figure 3:
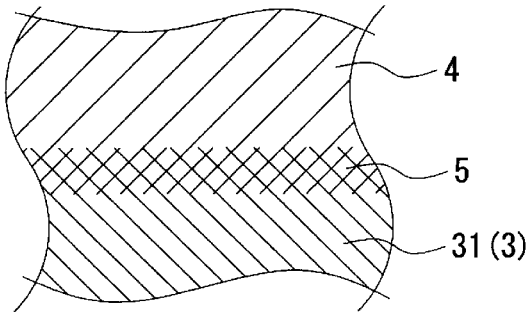
FIG. 3 is a cross-sectional view schematically showing the connector device taken along a cross-sectional line (III)-(III) in FIG. 1.

The welded portion 5 is formed by welding the constituent materials of the housing 31 and the molded resin portion 4 to each other (see FIG. 3). The term welding means satisfying at least one of the fact that the constituent materials are mixed with each other, the fact that the constituent materials are compatible with each other, the fact that material destruction occurs rather than interface destruction due to shearing force, and the fact that the surface of the connector 3 becomes rough. Interface destruction means that destruction occurs at the interface between the housing 31 and the molded resin portion 4. Therefore, the housing 31 and the molded resin portion 4 are separated along their interface with each other. The constituent material of one member of the housing 31 and the molded resin portion 4 does not adhere to the constituent material of the other member. Material destruction means that destruction occurs inside one member of the housing 31 and the molded resin portion 4. Therefore, the two members are separated from each other in a state in which the constituent material of one member is adhered on the surface of the other member facing the one member. This welded portion 5 can increase the adhesion between the housing 31 and the molded resin portion 4.

Figure 2:
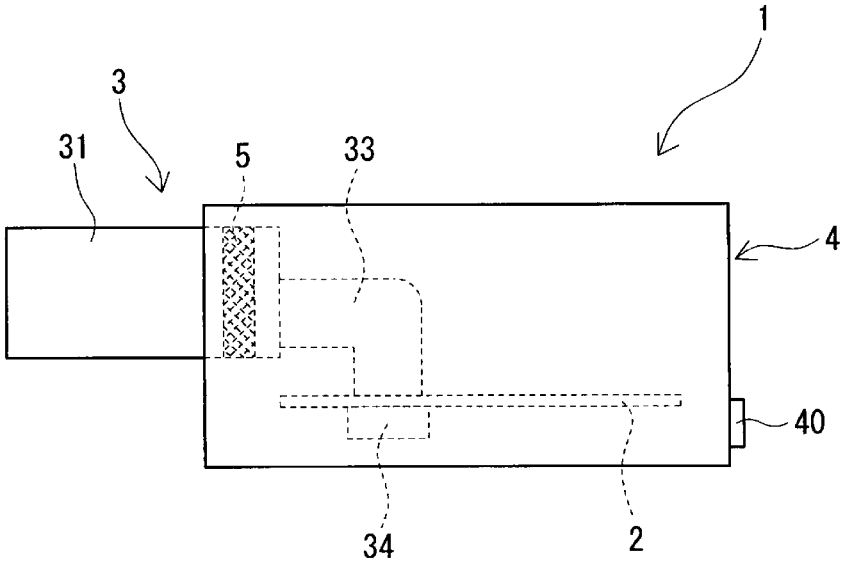
FIG. 2 is a side view showing an overview of the connector device according to Embodiment 1.

The area where the welded portion 5 is formed is a cylindrical area between the outer peripheral surface of the housing 31 and the inner peripheral surface of the molded resin portion 4 that contacts the outer peripheral surface of the housing 31 (see FIGS. 1 and 2). In the present embodiment, the welded portion 5 is provided over the entire circumference of the cylindrical area. Therefore, intrusion of a liquid such as water from between the housing 31 and the molded resin portion 4 can be suppressed. Therefore, it is possible to suppress the liquid from adhering to the conductor path 20 of the circuit board 2 and the terminal 32 of the connector 3.

As a method for forming the welded portion 5, laser welding can be used. A laser irradiates an overlapping area (a contact area) that overlaps (contacts) the molded resin portion 4 on the outer peripheral surface of the housing 31. The laser irradiation may be performed from the outside of the molded resin portion 4 in the normal direction of the outer peripheral surface of the housing 31. Because the laser transmittance of the molded resin portion 4 is high as described above, it is easy to transmit the laser light. Because the housing 31 has a low transmittance as described above, it is easy to absorb the laser. The overlapping area on the outer peripheral surface of the housing 31 is melted by the absorption of the laser. The molded resin portion 4 is melted by the heat at which the contact face of the housing 31 melts. By the constituent materials of the housing 31 and the molded resin portion 4 melting, the constituent materials are mixed with each other. By curing in a state where the constituent materials have been mixed, the welded portion 5 is formed.

Irradiation conditions for laser welding can be appropriately selected. Examples of the type of laser include a solid-state laser, a semiconductor laser, and a fiber laser. The wavelength of the laser may be, for example, 800 nm or more and 990 nm or less, furthermore 850 nm or more and 990 nm or less, and particularly 930 nm or more and 950 nm or less. The wavelength of the laser is preferably 940 nm. Although the output of the laser depends on the materials of the housing 31 and the molded resin portion 4, the wavelength may be, for example, 10 W or more and 100 W or less, furthermore 20 W or more and 90 W or less, and particularly 30 W or more and 60 W or less. The scanning speed of the laser depends on the material, thickness, and shape of the housing 31 and the molded resin portion 4, but the scanning speed may be, for example, 5 mm/min or more and 50 mm/min or less, furthermore 10 mm/min or more and 40 mm/min or less, and particularly 20 mm/min or more and 30 mm/min or less.

[Usage]

The connector device 1 of the present embodiment can be suitably used for an engine control unit of an automobile, a module of an electric brake system of an automobile, or the like. An example of an engine control unit is an engine control unit for fuel injection control (Fuel Injection Engine Control Unit: FI-ECU). Examples of a module of an electric brake system include a module of an electric mechanical brake (Electro Mechanical Break: EMB) and a module of an electric parking brake (Electronic Parking Brake: EPB).

[Working Effects]

The connector device 1 of the present embodiment exhibits the following effects.

(1) The connector device 1 of the present embodiment is excellent for waterproof performance. This is because the adhesion between the housing 31 and the molded resin portion 4 is high due to the welded portion 5, and therefore it is easy to suppress intrusion of a liquid from a gap between the housing 31 and the molded resin portion 4. As a result, it is possible to suppress adherence of the liquid to conductive members such as the conductor path 20, the connector terminal 32, or the like that are covered with the molded resin portion 4.

(2) With the connector device 1 of the present embodiment, it is easy to reduce the size of the connector device 1. Because the molded resin portion 4 collectively covers the circuit board 2 and the like, it is not necessary to separately provide a housing (a case and a cover) that accommodates the circuit board 2 and the like.

(3) The connector device 1 of the present embodiment is easy to manufacture. The reason for this is that because the housing and the sealing material are unnecessary, the number of components is small. In addition, the work of arranging the sealing material on the housing and the work of assembling the housing are unnecessary. The housing is unnecessary because the circuit board 2 and the like are collectively covered by the molded resin portion 4 as described above. The sealing material is unnecessary because sufficient waterproof performance is provided by the welded portion 5.

Test Example 1

Figure 4A:
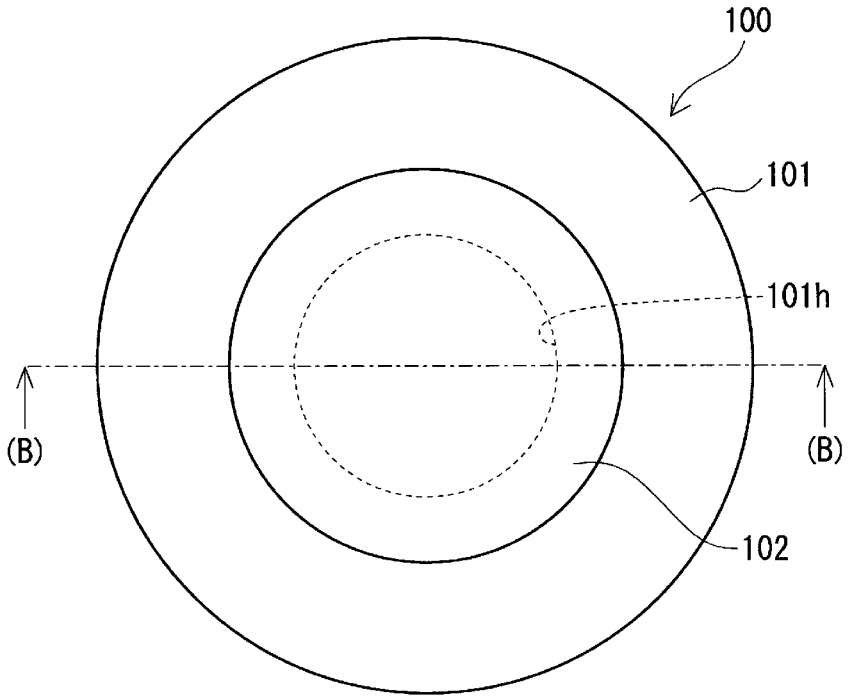
FIG. 4A is a plan view showing a first test piece used in a test that evaluates waterproof performance.
Figure 4B:
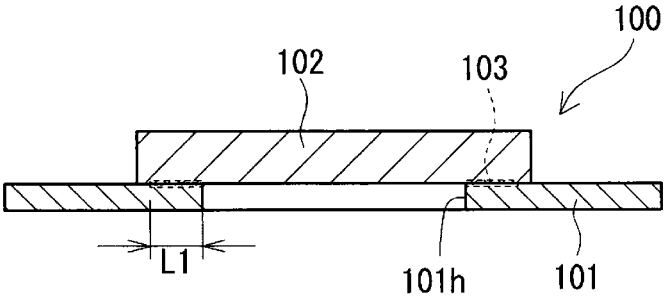
FIG. 4B is a cross-sectional view showing the first test piece taken along a cross-sectional line (B)-(B) in FIG. 4A.
Figure 5:
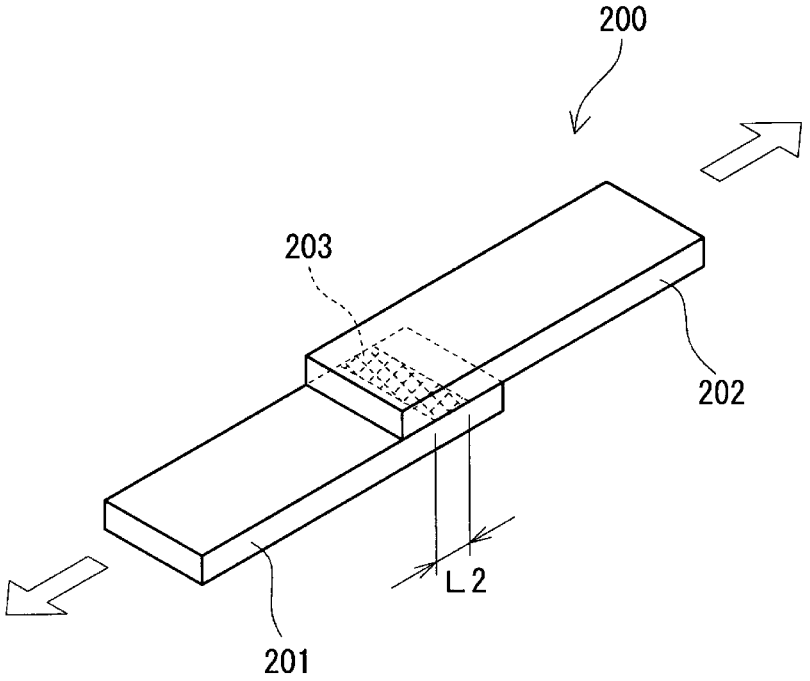
FIG. 5 is a perspective view showing a second test piece used in a shear tension test that evaluates adhesive performance.

The difference in waterproof performance and the difference in adhesive performance depending on the presence or absence of the welded portion was investigated. Evaluation of the waterproof performance was performed using a first test piece 100 shown in FIGS. 4A and 4B. Evaluation of the adhesive performance was performed using a second test piece 200 shown in FIG. 5. Each of the test pieces 100 and 200 is a member simulating a joint location between a connector and a molded resin portion.

[Samples 1 to 3]

[First Test Piece]

The first test piece 100 of samples 1 to 3 (see FIGS. 4A and 4B) was produced through a step of preparing an annular member 101, a step of forming a disk member 102 at a predetermined location on the upper surface of the annular member 101, and a step of forming a welded portion 103 in the overlapping area of the annular member 101 and the disk member 102, by performing those respective steps in that order. Here, the annular member 101 side is set to the lower side and the disk member 102 side is set to the upper side of the first test piece 100.

(Preparation of Annular Member)

As shown in Table 1, the material of the prepared annular member 101 was PBT having a transmittance of 1%. The annular member 101 is provided with a through hole 101*h* at the center of the annular member 101 so as to pass through the upper and lower surfaces. The inner peripheral shape of the through hole 101*h* is cylindrical. The inner diameter of the annular member 101 (the diameter of the through hole 101*h*) is 20 mm. The outer diameter of the annular member 101 is 50 mm. The thickness of the annular member 101 is 1 mm (Formation of Disk Member)

The disk member 102 was formed by injection molding. As shown in Table 1, a thermoplastic polyester elastomer having a transmittance of 40% (Hytrel 4767N manufactured by DuPont-Toray Co. (Hytrel is a registered trademark)), a thermoplastic polyester elastomer having a transmittance of 45% (Hytrel 4047N manufactured by DuPont-Toray Co. (Hytrel is a registered trademark)), or a polyamide having a transmittance of 90% (softening point: 188° C.) was used as the material of the second member.

The disk member 102 is arranged concentrically above the annular member 101. The outer peripheral edge of the disk member 102 is overlapped with the inner peripheral edge on the upper surface of the annular member 101. With this arrangement, the upper opening (the near side in the drawing of FIG. 4A, and the upper side in the drawing of FIG. 4B) of the through hole 101*h* of the annular member 101 is closed by the disk member 102. The diameter of the disk member 102 was 30 mm. The thickness of the disk member 102 was 2 mm. The planar shape of the overlapping area (contact area) between the annular member 101 and the disk member 102 is annular. The width (difference in inner and outer diameters) of the annular overlapping area (contact area) is uniform in the circumferential direction, and this width is 5 mm (Formation of Welded Portion)

Formation of the welded portion 103 was performed by laser welding. The laser spot diameter was 1.2 μm. The wavelength of the laser was 940 nm. The output of the laser was 45 W, 35 W, and 30 W as shown in Table 1. As shown in Table 1, the scanning speed of the laser was either 50 mm/min or 10 mm/min. The laser was irradiated to the overlapping area on the upper surface of the annular member 101 from above the disk member 102 in the direction normal to the upper surface of the annular member 101. The laser irradiation was performed over the entire circumference of the overlapping area on the upper surface of the annular member 101. By laser irradiation, the welded portion 103 was formed over the entire circumference of the overlapping area. The length L1 of the welded portion 103 in the radial direction was substantially 4 mm

[Second Test Piece]

The second test piece 200 of the samples 1 to 3 (see FIG. 5) was mainly produced through the same steps as the first test piece 100, except that the shape of the constituent members was different from the first test piece 100. Here, a first rectangular plate 201 side is set to the lower side and a second rectangular plate 202 side is set to the upper side of the second test piece 200.

(Preparation of First Rectangular Plate)

As shown in Table 2, the material of the prepared first rectangular plate 201 was the same PBT as the annular member 101 of the first test piece 100. The width of the first rectangular plate 201 is 25 mm. The length of the first rectangular plate 201 is 80 mm. The thickness of the first rectangular plate 201 is 1 mm (Formation of Second Rectangular Plate)

The second rectangular plate 202 was formed by injection molding. As shown in Table 2, the material of the second rectangular plate 202 was either the same thermoplastic polyester elastomer (Hytrel 4767N or Hytrel 4047N) or polyamide as the disk member 102 of the first test piece 100. The second rectangular plate 202 was formed such that one end of the lower surface of the second rectangular plate 202 makes contact with one end of the upper surface of the first rectangular plate 201. The width and length of the second rectangular plate 202 were the same as those of the first rectangular plate 201. The thickness of the second rectangular plate member 202 was 2 mm. The length of the overlapping area between the first rectangular plate 201 and the second rectangular plate 202 was 10 mm (Formation of Welded Portion)

Formation of the welded portion 203 was performed by laser welding. The laser spot diameter, wavelength, output, and scanning speed were the same as those of the first test piece 100, as shown in Table 2. The laser was irradiated to the overlapping area on the upper surface of the first rectangular plate 201 from above the second rectangular plate 202 in the direction normal to the upper surface of the first rectangular plate 201. The laser irradiation was performed over the entire length in the width direction of the overlapping area on the upper surface of the first rectangular plate 201. By laser irradiation, the welded portion 203 was formed over the entire length of the overlapping area in the width direction. The length L2 of the welded portion 203 in the longitudinal direction of each plate was substantially 2 mm

[Evaluation of Waterproof Performance]

The waterproof performance of the first test piece 100 of each sample was evaluated as follows. A cylindrical member (not shown) surrounding the outer periphery of the disk member 102 was provided on the outer peripheral edge of the upper surface of the annular member 101. The annular member 101 and the cylindrical member were joined such that water does not leak from the gap between the outer peripheral edge of the upper surface of the annular member 101 and the cylindrical member. In addition, a container-like member (not shown) surrounding the periphery of the opening of the through hole 101*h* was provided on the lower surface of the annular member 101. The annular member 101 and the container-like member were joined such that air does not leak from the gap between the lower surface of the annular member 101 and the container-like member, and a closed space was formed between the annular member 101 and the container-like member. Water was filled in a space surrounded by the upper surface of the first test piece 100 and the inner peripheral surface of the cylindrical member. Then, the pressure (gauge pressure) in the closed space was changed from 200 kPa to 500 kPa as shown in Table 1. At each pressure, the degree of air leakage from the gap between the upper surface of the annular member 101 and the lower surface of the disk member 102 was examined. The degree of air leakage was visually observed to determine whether or not air bubbles were generated in the water. The number of measurements (number N) of each sample was 5. In each sample, all five first test pieces 100 in which no bubbles were generated in the water were designated as "A". Any one of the five first test pieces 100 in which bubbles were generated in the water was designated as "B". Results of this are shown in Table 1.

[Evaluation of Adhesive Performance]

The adhesive strength of the second test piece 200 of each sample was evaluated by performing a shear tension test. For the shear tension test, an autograph (AGS-X series) manufactured by Shimadzu Corporation was used. As shown by the empty arrows in FIG. 5, the first rectangular plate 201 and the second rectangular plate 202 were pulled in the directions in which they separate from each other in the length direction until they were separated from each other. The maximum tensile stress at that time was determined. The number of measurements (number N) of each sample was 5. Table 2 shows the average value of the maximum tensile stress. Further, the opposing surfaces of the separated first rectangular plate 201 and second rectangular plate 202 were visually observed, and the form of destruction was examined Those results are also shown in Table 2. "Material destruction" in Table 2 indicates that destruction occurred inside one of the plates among the first rectangular plate 201 and the second rectangular plate 202. That is, the constituent material of one plate material adhered to the surface of the other separated plate material. In addition, "interface destruction" indicates that destruction occurred at the interface between the first rectangular plate 201 and the second rectangular plate 202. That is, the two plate materials were separated along the interface between each other without the constituent material of one plate material adhering to the surface of the other separated plate material.

[Samples 101 to 103]

[First Test Piece and Second Test Piece]

The first test piece and the second test piece of samples 101 to 103 respectively were produced in the same manner as the first test piece and the second test piece of the samples 1 to 3, except that a welded portion was not formed. That is, in the first test piece of the samples 101 to 103, the constituent materials of the annular member and the disk member are not welded. In this first test piece, the annular member and the disk member are simply adhered by the injection molding of the constituent material of the disk member. Also, in the second test piece of the samples 101 to 103, the constituent materials of the first rectangular plate and the second rectangular plate are not welded to each other. In this second test piece, the first rectangular plate and the second rectangular plate are simply adhered by the injection molding of the constituent material of the second rectangular plate. Using the first test piece and the second test piece, the waterproof performance and the adhesive performance were evaluated in the same manner as in the sample 1. Those results are shown in Tables 1 and 2.

TABLE 1

| | First Test Piece | | | Laser | | | | | |
|---|---|---|---|---|---|---|---|---|---|
| | Annular Member | Disk Member | Welding Portion | Output | Scanning Speed | Waterproof Performance Air Pressure | | | |
| Sample | Material | Material | Present/Absent | W | mm/min | 200 kPa | 300 kPa | 400 kPa | 500 kPa |
| 1 | PBT | Hytrel 4767N | Present | 45 | 50 | A | A | A | A |
| 2 | PBT | Hytrel 4047N | Present | 35 | 10 | A | A | A | A |
| 3 | PBT | Polyamide | Present | 30 | 10 | A | A | B | B |

TABLE 1-continued

| | First Test Piece | | | Laser | | | | | |
|---|---|---|---|---|---|---|---|---|---|
| | Annular Member | Disk Member | Welding Portion | Output | Scanning Speed | Waterproof Performance Air Pressure | | | |
| Sample | Material | Material | Present/Absent | W | mm/min | 200 kPa | 300 kPa | 400 kPa | 500 kPa |
| 101 | PBT | Hytrel 4767N | Absent | — | — | B | B | B | B |
| 102 | PBT | Hytrel 4047N | Absent | — | — | B | B | B | B |
| 103 | PBT | Polyamide | Absent | — | — | B | B | B | B |

TABLE 2

| | Second Test Piece | | | Laser | | Adhesive Performance | |
|---|---|---|---|---|---|---|---|
| Sample | First Rectangular Plate Material | Second Rectangular Plate Material | Welding Portion Present/Absent | Output W | Scanning Speed mm/min | Maximum Tensile Stress Mpa | Destruction Mode |
| 1 | PBT | Hytrel 4767N | Present | 45 | 50 | 6.89 | Material Destruction |
| 2 | PBT | Hytrel 4047N | Present | 35 | 10 | 4.92 | Material Destruction |
| 3 | PBT | Polyamide | Present | 30 | 10 | 2.76 | Interface Destruction |
| 101 | PBT | Hytrel 4767N | Absent | — | — | — | Interface Destruction |
| 102 | PBT | Hytrel 4047N | Absent | — | — | — | Interface Destruction |
| 103 | PBT | Polyamide | Absent | — | — | — | Interface Destruction |

As shown in Table 1, in the first test piece 100 of the samples 1 and 2, air bubbles were not generated in water when the air pressure was any of 200 kPa to 500 kPa. In the first test piece 100 of the sample 3, air bubbles were not generated in water when the air pressure was 200 kPa and 300 kPa. In the first test piece 100 of the sample 103, air bubbles were generated in water when the air pressure was any of 200 kPa to 500 kPa. From these results, it is understood that the samples 1 to 3 have high waterproof performance, and in particular, it is understood that the samples 1 and 2 have high waterproof performance That is, it is understood that by providing the welded portion, there is excellent waterproof performance.

As shown in Table 2, the maximum tensile stress of the second test piece 200 of the samples 1 to 3 is 2.5 MPa or more. In addition, the maximum tensile stress of the second test piece 200 of the sample 2 is 4.5 MPa or more, which is about 1.8 times that of the sample 3. The maximum tensile stress of the second test piece 200 of the sample 1 was 6.5 MPa or more, which is about 2.5 times that of the sample 3. From these results, it is understood that the samples 1 to 3 have high adhesive performance, and in particular, it is understood that the samples 1 and 2 have high adhesive performance. That is, it is understood that by providing the welded portion, there is excellent adhesive performance.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector device comprising:

a circuit board;

a connector; and a molded resin portion, wherein the circuit board includes a conductor path, the connector includes a housing containing a resin, and a terminal protruding from the housing and connected to the conductor path, the molded resin portion entirely covers the conductor path, the terminal protruding from the housing, and a part of the housing, the housing and the molded resin portion include a welded portion where constituent materials are welded to each other, and the housing contains a same type of resin as the molded resin portion.

2. The connector device according to claim 1, wherein where transmittance of the molded resin portion is defined as 100×a ratio (b1/a1) of a light amount a1 of a laser having a wavelength of 940 nm and a light amount b1 transmitted by the laser through a test piece having a thickness of 2 mm formed of constituent material of the molded resin portion, the transmittance of the molded resin portion is 40% or more.

3. The connector device according to claim 1, wherein where transmittance of the housing is defined as 100×a ratio (b2/a2) of a light amount a2 of a laser having a wavelength of 940 nm and a light amount b2 transmitted by the laser through a test piece having a thickness of 2 mm formed of constituent material of the housing, the transmittance of the housing is 10% or less.

4. The connector device according to claim 1, wherein the molded resin portion contains a polyamide resin or a polyester.

5. The connector device according to claim 1, wherein the housing contains a polyester.

6. The connector device according to claim 1, wherein both the molded resin portion and the housing contain a polyester.

7. The connector device according to claim 1, wherein the molded resin portion has a surface that makes contact with the atmosphere.

8. The connector device according to claim 1, wherein the molded resin portion is an injection molded body.

9. The connector device according to claim 1, wherein the circuit board and the connector form a control unit.

10. The connector device according to claim 1, wherein one end of the terminal is connected to the housing and a remaining end of the terminal is connected to the conductor path.

11. The connector device according to claim 5, wherein the housing contains a coloring agent.

12. The connector device according to claim 11, wherein the coloring agent of the housing is a carbon black.

* * * * *